US008564158B2

(12) United States Patent
Poyner et al.

(10) Patent No.: US 8,564,158 B2
(45) **Date of Patent: *Oct. 22, 2013**

(54) APPLIANCE HAVING USER DETECTION FUNCTIONALITY FOR CONTROLLING OPERATION THEREOF

(75) Inventors: Dennis A. Poyner, Kinston, NC (US); David C. Sumner, Greenville, NC (US); Kyle T. Perkinson, Greenville, NC (US); Troy A. Dalsing, Kinston, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 732 days.

This patent is subject to a terminal disclaimer.

(21) Appl. No.: 12/764,598

(22) Filed: Apr. 21, 2010

(65) Prior Publication Data

US 2011/0260553 A1 Oct. 27, 2011

(51) Int. Cl.
*H01H 19/10* (2006.01)

(52) U.S. Cl.
USPC ..... 307/115; 307/125; 307/132 EA; 307/142

(58) Field of Classification Search
USPC ..... 307/115
See application file for complete search history.

(56) References Cited

U.S. PATENT DOCUMENTS 4,362,954 A * 12/1982 Cotton ..... 307/142
4,628,443 A 12/1986 Rickard et al.
4,661,685 A 4/1987 Contri
4,775,913 A 10/1988 Ekblad
4,866,955 A 9/1989 Blair et al.
5,202,582 A 4/1993 Szynal et al.
5,805,767 A 9/1998 Jouas et al.
6,002,119 A * 12/1999 Kim ..... 219/722
6,107,698 A 8/2000 Ochiai et al.

(Continued)

FOREIGN PATENT DOCUMENTS

DE 27 23 325 12/1978
DE 43 33 442 4/1995

(Continued)

OTHER PUBLICATIONS

International Search Report and Written Opinion for International Application No. PCT/US2011/032466, mailed Jul. 27, 2011.

(Continued)

*Primary Examiner* — Rexford Barnie
*Assistant Examiner* — Toan Vu
(74) *Attorney, Agent, or Firm* — Alston & Bird LLP

(57) ABSTRACT

An apparatus is provided that includes first, second and third switches, the first and second of which are in line between an appliance and terminals of the appliance that are connectable to a power source. The first switched is configured to open and close based on closing and opening of a door of the appliance, and the second switch is configured to open and close based on the mode of the appliance. Thus, the appliance may be connected to the power source when the first switch or the second switch is closed, and disconnected from the power source when both the first switch and the second switch are open. The third switch, which includes a sensor, is configured to control the second switch to close upon actuation in response to a detection proximate the appliance, where actuation of the third switch may cause the appliance to enter an operational mode.

21 Claims, 4 Drawing Sheets

(56) References Cited

U.S. PATENT DOCUMENTS

| | | | | |
|---|---|---|---|---|
| 6,279,587 | B1 | 8/2001 | Yamamoto | |
| 6,331,699 | B1 * | 12/2001 | Ito et al. | 219/715 |
| 6,363,755 | B1 | 4/2002 | Hapke et al. | |
| 6,469,920 | B2 | 10/2002 | Butler et al. | |
| 6,650,030 | B2 | 11/2003 | Has | |
| 6,684,111 | B2 | 1/2004 | Klein et al. | |
| 6,825,453 | B2 | 11/2004 | Kang et al. | |
| 7,068,145 | B2 | 6/2006 | Reitmeier | |
| 7,342,492 | B2 | 3/2008 | Ludenia | |
| 7,369,685 | B2 | 5/2008 | DeLean | |
| 7,418,969 | B1 | 9/2008 | Crisp, III | |
| 2003/0024796 | A1 | 2/2003 | Peterson et al. | |
| 2004/0088797 | A1 * | 5/2004 | Darby | 8/159 |
| 2005/0084118 | A1 | 4/2005 | Schaupert et al. | |
| 2005/0151620 | A1 | 7/2005 | Neumann | |
| 2006/0109138 | A1 * | 5/2006 | Chiang | 340/825.69 |
| 2007/0131258 | A1 | 6/2007 | Gault | |
| 2007/0273475 | A9 | 11/2007 | Neumann | |
| 2008/0195874 | A1 | 8/2008 | Zhou | |
| 2009/0021969 | A1 | 1/2009 | Butler et al. | |
| 2009/0125736 | A1 | 5/2009 | Woo | |

FOREIGN PATENT DOCUMENTS

| | | | |
|---|---|---|---|
| DE | 101 22 402 | | 11/2002 |
| DE | 102 56 464 | | 6/2004 |
| DE | 20 2006 018 467 | | 4/2007 |
| DE | 10 2007 058 380 | | 6/2009 |
| EP | 0 775 463 | A2 | 5/1997 |
| EP | 1 263 265 | A2 | 12/2002 |
| EP | 1 460 361 | A1 | 9/2004 |
| JP | 10-261483 | A | 9/1998 |
| JP | 2007-301263 | | 11/2007 |
| JP | 2008-148955 | | 7/2008 |
| KR | 10-2006-0077280 | | 7/2006 |
| KR | 10-2006-0100707 | | 9/2006 |
| WO | WO 2008/139215 | | 11/2008 |

OTHER PUBLICATIONS

International Search Report and Written Opinion for International Appl. No. PCT/US2010/055223, mailed Jan. 10, 2011.

* cited by examiner

APPLIANCE HAVING USER DETECTION FUNCTIONALITY FOR CONTROLLING OPERATION THEREOF

FIELD

Exemplary embodiments of the present invention generally relates to operation control in an appliance, and more particularly, to an apparatus having user detection functionality for controlling operation thereof.

BACKGROUND

Injury data reported by the National Electronic Injury Surveillance System (NEISS) indicates that there is no continuous parental monitoring or adult supervision and control of children while they are in the vicinity of household appliances. As a result, many children have been injured from mishandling appliances, such as dishwashers. A trend in operation control for appliance applications has therefore been to provide mechanisms to safeguard against injuries suffered by children mishandling appliances.

A trend in operation control for low-power microprocessor applications has been to use a processor feature called "sleep mode." In this mode, the processor consumes an extremely small amount of power and has drastically reduced functionality. When called upon, it can be taken out of sleep mode either by a timer, or by a signal to a certain pin of the processor. After the processor is taken out of sleep mode, it is capable of performing a particular function and then returning to the sleep mode. For example, cell phones may be configured to "wake up" for only a few microseconds once every second to check and see if there is an incoming call. However, such a sleep mode configuration still consumes power/energy. As such, in some instances, it may be desirable for the processor to use no power when not needed. Particularly, such a zero standby power processor/controller may be advantageous when applied in the context of appliances.

SUMMARY

In light of the foregoing background, exemplary embodiments of the present invention provide an appliance having user detection functionality for controlling operation of the appliance ("exemplary" as used herein referring to "serving as an example, instance or illustration"). According to one aspect of exemplary embodiments of the present invention, and apparatus is provided that includes first, second and third switches. The first and second switches are connected in line between an appliance and terminals of the appliance that are connectable to a power source of the appliance. When the terminals are connected to the power source, the first switch is configured to close when a door of the appliance is at least partially open to thereby connect the appliance to the power source, and configured to open when the door is closed to thereby disconnect the appliance from the power source. Similarly, the second switch is configured to close when the appliance enters an operational mode to thereby connect the appliance to the power source, and configured to open when the appliance enters an unpowered mode to thereby disconnect the appliance from the power source (which may thereby result in an intentional power down of the appliance). Thus, the appliance may be connected to the power source when at least one of the first switch or the second switch is closed, and disconnected from the power source when both the first switch and the second switch are open.

The third switch is electrically connected to the second switch and configured to control the second switch to close upon actuation of the third switch. In this regard, the third switch comprises a sensor configured to actuate in response to the sensor detecting a presence of a material, object or user in proximity of the appliance of a particular area of the appliance. When the appliance is in the unpowered mode, actuation of the third switch causes the appliance to enter the operational mode.

The apparatus may further include a latch circuit electrically connected to and configured to control operation of the second switch. The latch circuit may be configured such that when the appliance is in the unpowered mode and the second switch is open, the latch circuit is powered by the power source through the first switch when the door of the appliance is at least partially open and the first switch is closed. Additionally or alternatively, the latch circuit may be configured such that when the appliance is in the unpowered mode and the first switch is open, the latch circuit is powered by an energy storage device electrically connected to the latch circuit. In such instances, the energy storage device may comprise a capacitor, battery and/or solar cell. When the energy storage device includes a capacitor, the capacitor may be arranged such that the capacitor is charged by the power source when at least one of the first switch or the second switch is closed.

The apparatus may further comprise a processor configured to control operation of the appliance, including being configured to control the second switch to open and thus control the appliance to enter the unpowered mode. The processor may be configured to set a flag in memory when the processor controls the appliance to enter the unpowered mode. And the processor may be configured to check the flag when the appliance enters the operational mode to determine if a preceding power down of the appliance was intentional or unintentional. The processor may be further configured to perform one or more error-handling operations, including being configured to direct presentation of indicia of the unintentional power down on a user interface of the apparatus, when the processor determines (based on the check of the flag) that the preceding power down of the appliance was unintentional. Otherwise, the processor may be configured to reset the flag and control the appliance to enter the operational mode when the processor determines (based on the check of the flag) that the preceding power down of the appliance was intentional.

Even further, the appliance may include one or more sensors configured to measure one or more characteristics of the material, object or user in proximity of the appliance or particular area of the appliance, and produce signals corresponding to the measured one or more characteristics. The sensor(s) may include or be distinct from the sensor of the third switch. The processor may be configured to receive the signals from the one or more sensors, and control operation of the appliance based on the signals. In this regard, the processor may be configured to apply logic to the signals to determine one or more operations, and control the appliance to perform the respective one or more operations. The logic may include, for example, logic directing comparison of the signals to one or more predetermined signatures of multiple values that indicate a particular material, object or user, and directing performance of one or more operations based on the comparison. Additionally or alternatively, for example, the logic may include logic directing comparison of the signals to one or more predetermine threshold values, and directing performance of one or more operations based on the comparison.

As indicated above and explained below, exemplary embodiments of the present invention may solve problems identified by prior techniques and provide additional advantages.

BRIEF DESCRIPTION OF THE DRAWINGS

Figure 1:
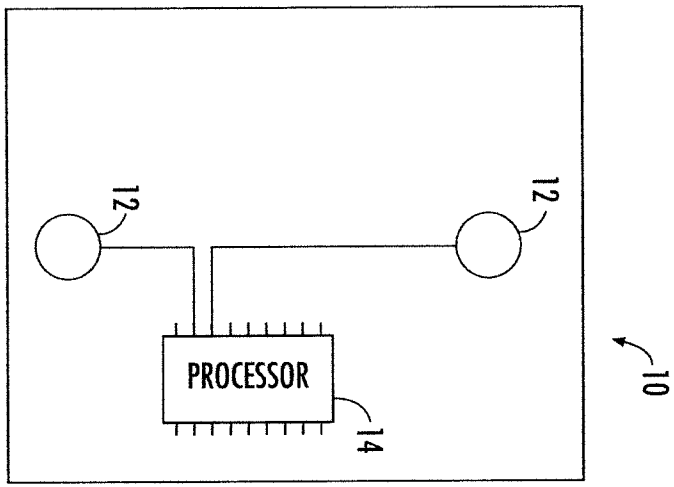
Figure 2:
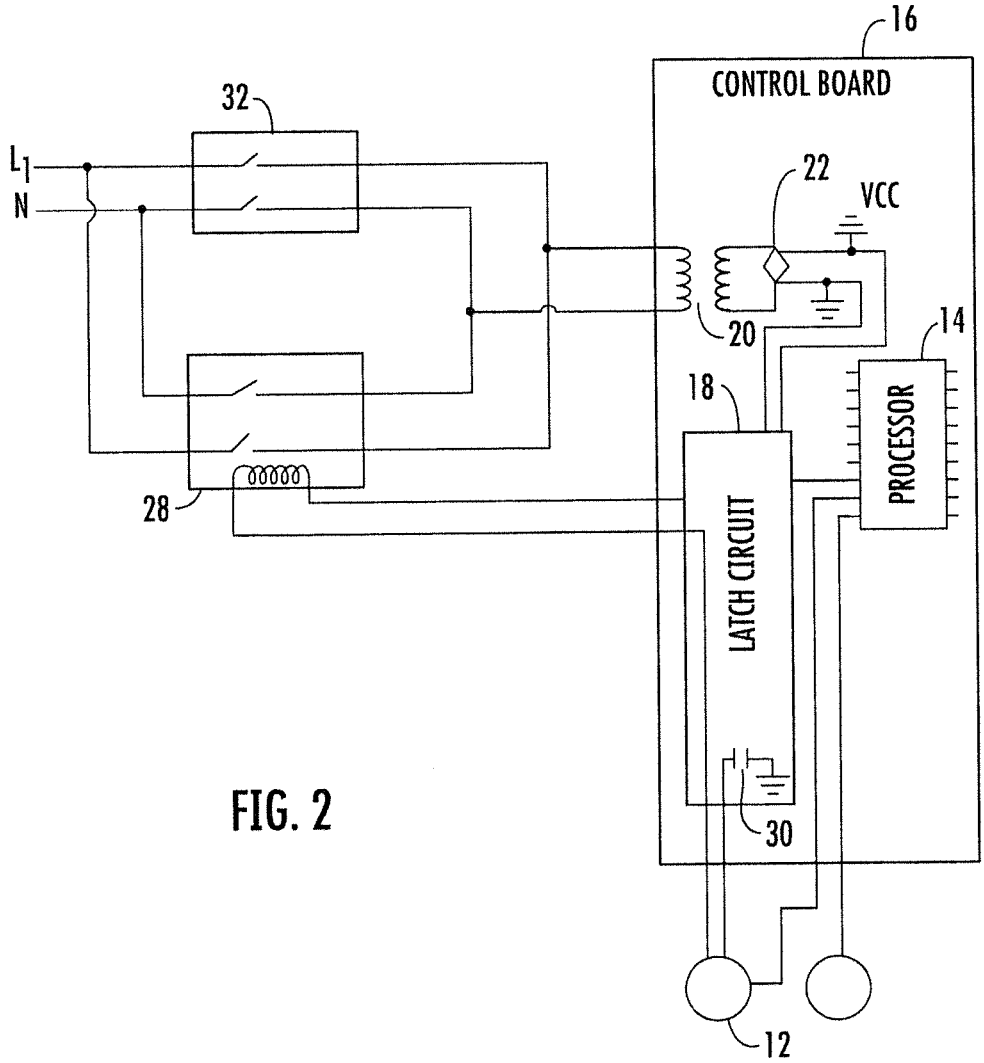
Figure 3:
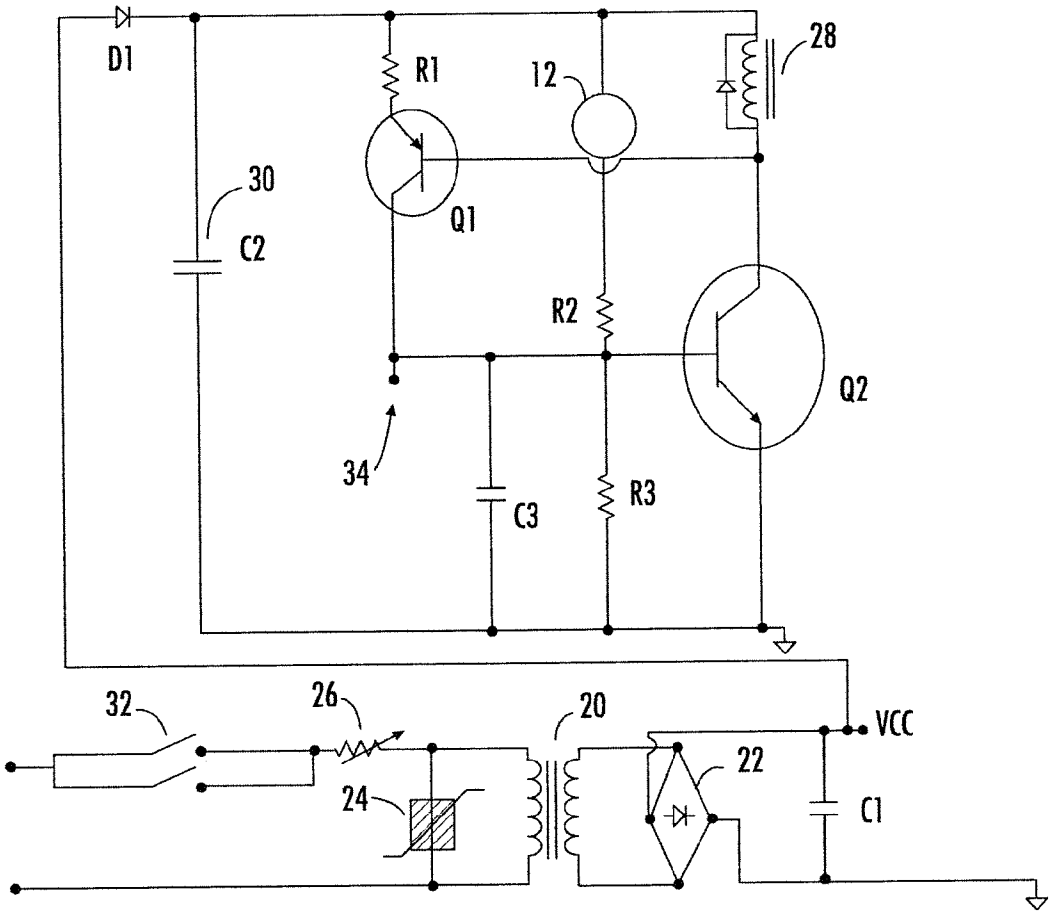
Figure 4:
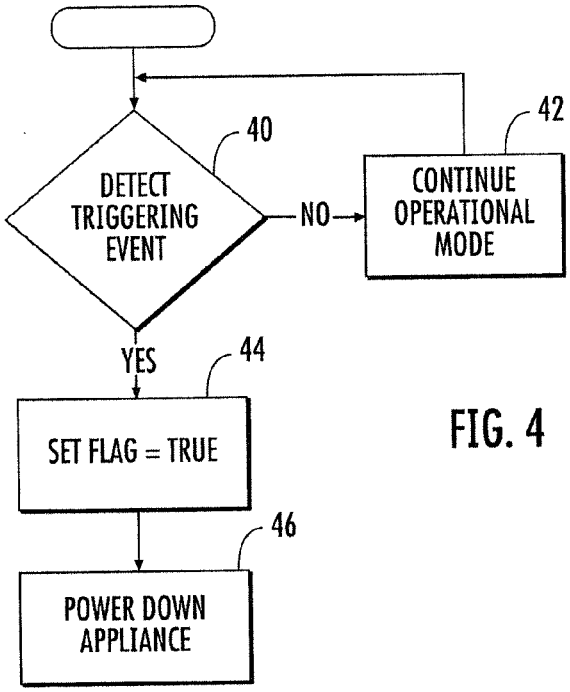
Figure 5:
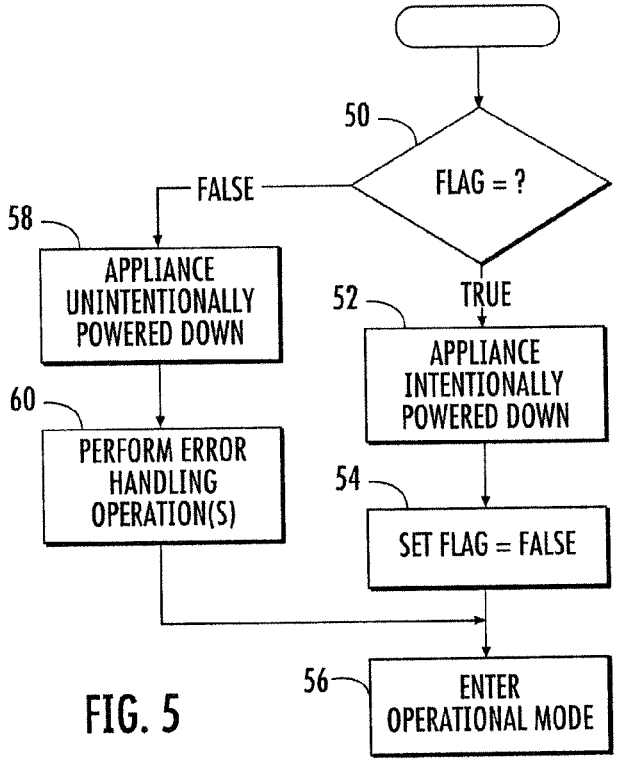

Having thus described exemplary embodiments of an appliance in general terms, reference will now be made to the accompanying drawings, which are not necessarily drawn to scale, and wherein:

FIG. 1 is a schematic block diagram of an appliance having user detection functionality for controlling operation thereof, according to exemplary embodiments of the present invention;

FIGS. 2 and 3 are schematic block diagrams of an apparatus for providing zero standby power control according to exemplary embodiments of the present invention; and FIGS. 4 and 5 are flowcharts illustrating various steps in powering down and powering on sequences or methods according to exemplary embodiments of the present invention.

DETAILED DESCRIPTION

The present invention now will be described more fully hereinafter with reference to the accompanying drawings, in which preferred exemplary embodiments of an appliance are shown. This invention may, however, be embodied in many different forms and should not be construed as limited to the embodiments set forth herein; rather, these embodiments are provided so that this disclosure will be thorough and complete, and will fully convey the scope of exemplary embodiments of the appliance to those skilled in the art. In this regard, exemplary embodiments of the present invention may be described herein in the context of a dishwasher appliance. It should be understood, however, that exemplary embodiments of the present invention may be equally applied to any of a number of other appliances. Examples of other appliances include kitchen and laundry appliances such as ovens, microwave ovens, refrigerators, freezers, washing machines, clothes dryers, drying cabinets, trash compactors or the like. Like numbers refer to like elements throughout.

Terms such as "substantially," "about," "nearly," "approximately" or the like as used in referring to a relationship between two objects or values are intended to reflect not only an exact relationship but also variances in that relationship that may be due to various factors such as common or accepted error tolerances, variations or the like. It should further be understood that although some values or other relationships may be expressed herein without a modifier, these values or other relationships may also be exact or may include a degree of variation due to various factors such as common or accepted error tolerances, risk tolerances, variations or the like.

FIG. 1 is a schematic block diagram of an appliance 10 having user detection functionality for controlling operation thereof, according to exemplary embodiments of the present invention. As shown, the appliance includes one or more sensors 12 and a processor 14. The sensors may comprise any of a number of different types of sensors configured to detect the presence, and in various instances measure one or more characteristics, of a material, object or user in proximity of the appliance or a particular area of the appliance, and produce signals corresponding to the detected presence and/or measured characteristic(s). Examples of suitable sensors include microphones, accelerometers, position sensors, tilt sensors, infrared sensors, passive infrared sensors, light sensors, proximity sensors, temperature gauges or thermometers, motion detectors, ultrasonic detection sensors or the like.

The sensors 12 may be mounted, affixed or otherwise disposed in any of a number of locations on the appliance 10 to facilitate detecting the presence, and/or measuring one or more characteristics, of a user in proximity of the appliance or a particular area of the appliance. The locations of the sensors in many instances will depend on the particular appliance. Generally, though, one or more of the sensors may be located proximate a user interface of the appliance. Additionally or alternatively, one or more sensors may be located proximate one or more components or areas of the appliance with which a material, object or user may come into contact. For example, one or more sensors may be located in the interior of appliances that have interior chambers for accepting articles such as food, clothing, tableware or the like. Additionally or alternatively, for example, one or more sensors may be located proximate a component or area of an appliance susceptible to producing a fire and, accordingly, a flame.

The processor 14 may include any of a number of different components configured to receive signals from the sensor(s) 12 and control operation of the appliance 10 based on those signals. For example, the processor may be embodied as a microprocessor, coprocessor, controller, special-purpose integrated circuit such as, for example, an ASIC (application specific integrated circuit), an FPGA (field programmable gate array), or a hardware accelerator, processing circuitry or the like. The processor may include a plurality of transistors, logic gates, a clock (e.g., oscillator), digital signal processors, other circuitry or the like to facilitate performance of the functionality described herein. Further, for example, the processor may include memory, such as in the form of volatile and/or non-volatile memory, configured to store executable software, firmware, data or the like, which may direct operation of the processor.

As indicated above, the processor 14 may be configured to receive, from one or more of the sensors 12, signals corresponding to a detected presence and/or measured characteristic(s) of a material, object or user in proximity of the appliance 10 or a particular area of the appliance. As or after receiving these signals, the processor may be configured to control operation of the appliance based on the signals, or more particularly, as a function of the detected presence and/or measured characteristic(s) of the respective material, object or user. In this regard, the processor may be configured apply logic, rules, functions or the like (generally referred to herein as "logic") to the signals to determine one or more operations of the appliance, and then control the appliance to perform the respective operation(s).

The processor 14 may be configured to apply any number of different logic to the signals. Some logic, for example, may direct performance of appliance operation(s) in response to any signal from particular sensor(s) 12. For example, logic may direct the processor to active a user interface of the appliance 10 in response to a signal corresponding to the detected presence of a material, object or user proximate the appliance. And in various instances, this may be further refined to a more likely detection of a user by similar logic specifying a detected presence proximate a user interface of the appliance.

Other logic, for example, may direct comparison of the signal(s) from particular sensor(s) 12 to predetermined threshold value(s), and performance of appliance operation(s) based on whether the signal(s) have values above, below or approximately equal to the threshold value(s). For example, logic may direct the processor 14 to provide a suitable alarm or other alert in response to signals corresponding to the detected presence of a material, object or user proximate a component or area of an appliance 10 susceptible to producing a flame, and which signals include a temperature above a threshold temperature.

Still other logic, for example, may direct comparison of the signals from particular sensor(s) 12 to predetermined signature(s) of multiple values that indicate a particular material, object or user, and performance of appliance operation(s) based on whether the signals indicate a substantial match to a particular signature. In one particular example, the processor 14 (or rather memory of the processor) may store biometric information in the form of sensor values (e.g., heat, movement, etc.) that distinguishes adult users from child users. In such instances, logic may direct the processor to perform particular appliance operation(s) in response to detecting the presence of a user, and based upon whether the detected user is an adult or child. For example, if the signals and stored biometric information suggest a child, the processor may be directed to disable certain functions of the appliance 10 or restrict access to certain portions of the appliance deemed hazardous (e.g., turning on an oven, locking the door of an oven, etc.), and/or provide a suitable alarm or other alert.

According to another aspect of exemplary embodiments of the present invention, one or more of the sensors 12 and processor 14 may be incorporated into an appliance having a zero standby power control. Briefly, and as explained in greater detail below, the appliance 10 may include a latch circuit configured to control operation of a relay switch, which itself may be configured to connect or disconnect the appliance from its power source. The relay switch may be configured to open when the appliance enters the unpowered mode to thereby disconnect the appliance from the power source, and close when the appliance enters the operational mode to thereby connect the appliance to the power source. In this regard, the appliance may be placed in or otherwise enter the unpowered and operational modes in any of a number of different manners. The processor 14 may be configured to control the relay switch to place the appliance 10 in the unpowered mode, such as at the conclusion of an operational cycle of the appliance. One or more sensors 12 may be configured to control the relay switch to place the appliance in the operational mode, such as in response to the detection of motion (or in various instances, detection of motion of an adult). To achieve zero-standby power in this aspect, the appliance may include an energy storage device (e.g., capacitor, battery, solar cell) to supply power to the detection sensor(s) when the appliance is in the unpowered mode.

Reference is now made to FIGS. 2 and 3, which illustrate various components of an appliance 10 in accordance with exemplary embodiments of the present invention. As shown, the appliance of this exemplary embodiment includes a control board 16 with various circuit components including a bridge rectifier circuit, processor 14 and latch circuit 18. The bridge rectifier circuit may include various components configured to convert power from a power source to a form more suitable to power various components of the appliance. Although not shown, the power source may be any of a number of different suitable sources of power, such as household AC power sources, mains power sources or the like (e.g., 120 VAC)—incoming to the appliance at line and neutral terminals $L_1$ and N.

For example, the bridge rectifier circuit may include a step-down transformer 20 and bridge rectifier 22 (e.g., full-wave bridge rectifier) configured to reduce a higher alternating-current (AC) voltage to a lower direct-current (DC) voltage (shown as VCC). As more particularly shown in FIG. 3, the bridge rectifier circuit may include a smoothing capacitor C1 to smooth the voltage variations output from the bridge rectifier. Further, the bridge rectifier circuit may also include a varistor 24 (e.g., metal oxide varistor—MOV), fuse 26 (e.g., polymeric positive temperature coefficient—PPTC—device), circuit breaker or the like so as to protect the appliance 10, and more particularly the control board, from damage due to excess current and/or voltage from the appliance's power source. It should be understood, however, that the power source may comprise any of a number of other power sources such as those configured to provide lower-power AC or DC voltage. In such instances, the control board 16 may not include the bridge rectifier circuit or one or more of its components (e.g., step-down transformer, bridge rectifier, smoothing capacitor, etc.).

The latch circuit 18 includes a number of circuit components configured to control operation of a relay switch 28 (including, e.g., a protection diode as shown in FIG. 3), which itself is configured to connect or disconnect the appliance 10 from its power source. The relay switch may be configured to actuate when the appliance enters an unpowered mode from an operational mode, and actuate again when the appliance enters the operational mode from the unpowered mode. More particularly, for example, the relay switch may be configured to open when the appliance enters the unpowered mode to thereby disconnect the appliance from the power source, and close when the appliance enters the operational mode to thereby connect the appliance to the power source. In this regard, the appliance may be placed in or otherwise enter the unpowered and operational modes in any of a number of different manners. In one exemplary embodiment, the processor 14 may be configured to control the relay switch to place the appliance in the unpowered mode, such as at the conclusion of an operational cycle of the appliance; and one or more sensors 12 may be configured to control the relay switch to place the appliance in the operational mode when the sensor(s) detect the presence of a material, object or user in proximity of the appliance or a particular area of the appliance In these instances, the sensor(s) may be configured as a switch that actuates in response to detecting the presence of the respective material, object or user, and may be configured to control the relay switch to place the appliance in the operational mode when actuated.

As explained above, the sensor(s) 12 may be situated at any of a number of different locations. In some exemplary embodiments, the sensor(s) are situated at a location on the appliance 10 that is accessible by a user when a door of the appliance is open or closed, such as on the outside of the door or a panel separate from the door. In other exemplary embodiments, however, the sensor(s) are situated at a location that is only accessible by the user when the door of the appliance is open, such as on the inside of the door.

In various exemplary embodiments, and particularly in instances in which the sensor(s) 12 are only accessible when the door is open, the latch circuit 18 may include an energy storage device. The energy storage device may comprise, for example, one or more of a capacitor 30 (shown in FIG. 3 as capacitor C2), battery, solar cell or the like. And as more particularly shown in FIG. 3, the latch circuit may also include other circuit components such as number of resistors (e.g., R1, R2, R3), capacitors (e.g., C1, C3), transistors (e.g., PNP transistor Q1, NPN transistor Q2), diodes (e.g., D1) or the like.

The energy storage device may be configured to hold a charge for an extended period of time, and may be rechargeable. In the context of a capacitor 30, for example, the capacitor may be relatively large—e.g., 3000 μF—so as to hold a charge for an extended period of time. The energy storage device may be arranged to supply power to the latch circuit 18 and sensor(s) 12, particularly in instances in which the appliance 10 is in the unpowered mode and the sensor(s) 12 are inaccessible when the door is closed. It should therefore be understood that when the sensor(s) are inaccessible when the door is closed (and hence when the hinge switch 32—explained below—is open), the appliance need not include the energy storage device. When the appliance includes the energy storage device and the device is rechargeable, however, the device may be further arranged to charge when the appliance is connected to the power supply (i.e., when either the relay switch 28 or hinge switch are closed). The operation of the components of the latch circuit of this exemplary embodiment will be described more fully below.

As further shown in FIG. 2, the appliance 10 may include a switch 32 coupled to a door of the appliance (referred to herein without loss of generality as a "hinge switch")—the switch shown as the hinge switch 32 in FIG. 3 representing both the hinge switch and contacts of the relay switch 28. Similar to the relay switch 28, the hinge switch is configured to connect or disconnect the appliance from its power source. The hinge switch may be configured to actuate when the door of the appliance is opened (partially or completely), and actuate again when the door is closed. More particularly, for example, the hinge switch may be configured to close when the door of the appliance is opened to thereby connect the appliance to the power source, and open when the door is closed to thereby disconnect the appliance from the power source. Thus, according to exemplary embodiments of the present invention, either the hinge switch or relay switch may be actuated (e.g., closed) to connect the appliance to its power source, or actuated (e.g., opened) to disconnect the appliance from is power source.

According to exemplary embodiments of the present invention, the appliance 10 may operate in the operational mode with the relay switch 28 closed and the hinge switch 32 open (the door of the appliance thereby being closed). At some point during or at the conclusion of operation in the operational mode, then, the appliance may enter the unpowered mode. In the context of a dishwasher, for example, the processor 14 may detect a triggering event such as the end of a wash cycle or expiration of a timeout due to lack of user interaction, and in response, enter the appliance into the unpowered mode. In this regard, the processor may be configured to send a signal to trigger the latch circuit 18 to open the relay switch to thereby disconnect the appliance from the power source (the hinge switch also being open).

At some point after entering the unpowered mode, the appliance 10 may again enter the operational mode, at which point the appliance may be reconnected to the power supply. In this regard, the appliance may power on to enter the operational mode upon actuation of the sensor(s) 12 to close the relay switch 28 to connect the appliance to the power supply, the sensor(s) being actuated in response to detecting the presence of a material, object or user in proximity of the appliance or a particular area of the appliance. As the appliance is not connected to the power supply in the unpowered mode, however, the latch circuit 18 may need sufficient power to actuate the relay switch. When the sensor(s) are accessible when the door is closed or the appliance otherwise includes an energy storage device (e.g., capacitor 30), power to the latch circuit may be supplied by the energy storage device. When the sensor(s) are inaccessible when the door is closed, the appliance does not include an energy storage device (e.g., capacitor 30), or the charge of the energy storage device is otherwise insufficient to power the latch circuit, power to the latch circuit 18 may be supplied by the power source by opening the door of the appliance sufficient to close the hinge switch 32.

More particularly with reference to FIG. 3, for example, powering on the appliance 10 from the unpowered mode to the operational mode may include actuation of the sensor(s) 12, which activates transistor Q2. Transistor Q2, in turn, activates transistor Q1. In addition, transistor Q2 energizes the relay switch 28, which closes to thereby connect the appliance to the power source. The latch circuit 18 latches the relay switch closed to supply continuous power to the appliance until the appliance again enters the unpowered mode, at which point the processor 14 may send a signal to a node 34 of the latch circuit, which causes the relay switch to open and disconnect the appliance from the power source (when the door is closed, and hence the hinge switch 32 is open).

As indicated above, the appliance 10 may be powered down or otherwise shutdown when the appliance enters the unpowered mode. In other instances, however, the appliance may be unintentionally powered down, such as due to a power source or other appliance failure or fault. Exemplary embodiments of the present invention may account for instances in which the appliance is unintentionally powered down, and to do so, the processor 14 may be further configured to distinguish an intentional powering down from an unintentional powering down. More particularly, for example, the processor may be configured to set a power-down flag in its memory when the processor intentionally powers down. Then, on subsequent powering on of the appliance, the processor may check the flag to determine if the appliance's previous powering down was intentional (the flag being set) or unintentional (the flag not being set).

Reference is now made to FIGS. 4 and 5, which illustrates various steps in powering down and powering on sequences or methods according to exemplary embodiments of the present invention. As shown at blocks 40 and 42, the powering down sequence includes the processor 14 monitoring for a triggering event, such as the end of an operation cycle of the appliance 10 (e.g., a wash cycle for a dishwasher) or expiration of a timeout due to lack of user interaction. Then, in response to the processor detecting a triggering event, the processor may set the flag (e.g., flag=true) and power down the appliance such as by sending a signal to trigger the latch circuit 18 to open the relay switch to thereby disconnect the appliance from the power source, as shown in blocks 44 and 46.

When the appliance 10 is again connected to its power source and enters the operational mode, the processor 14 may check the status of the flag. When the flag is set (e.g., flag=true), the processor identifies the previous powering down as having been intentional, resets the flag (e.g., flag=false) and enters the operational mode, as shown in blocks 52, 54 and 56. On the other hand, when the flag is not set (e.g., flag=false), the processor identifies the previous powering down as having been unintentional and performs one or more error-handling operations, and then if appropriate, enters the operational mode, as shown in blocks 58, 60 and 56.

These error-handling operation(s) may include, for example, the processor 14 directing presentation of an indicia of a prior unintentional powering down on the user interface of the appliance 10—such as by presenting a message or other indicator (e.g., blinking clock) on a display, triggering one or more light-emitting diodes (LEDs) to flash or the like. And more particularly in the context of a dishwasher appliance, for example, the error-handling operation(s) may include determining whether the temperature of any water in the dishwasher is still hot or is cold (e.g., above or below a threshold temperature). If the water is still hot, the processor may determine that the unintentional power outage was short, and thus may direct the dishwasher to continue running the last cycle; but if the water is cold, the processor may direct the dishwasher to drain and re-fill the dishwasher and repeat the last cycle.

For more information on the zero standby power control aspects of exemplary embodiments of the present invention, see U.S. patent application Ser. No. 12/622,149, entitled: Apparatus for Providing Zero Standby Power Control in an Appliance, filed on Nov. 19, 2009, the content of which is hereby incorporated by reference in its entirety.

According to one aspect of the present invention, all or a portion of the processor 14 of exemplary embodiments of the present invention, generally operate under control of a computer program. The computer program for performing the methods of exemplary embodiments of the present invention may include one or more computer-readable program code portions, such as a series of computer instructions, embodied or otherwise stored in a computer-readable storage medium, such as the non-volatile storage medium.

FIGS. 4 and 5 are flowcharts reflecting methods, systems and computer programs according to exemplary embodiments of the present invention. It will be understood that each block or step of the flowcharts, and combinations of blocks in the flowcharts, may be implemented by various means, such as hardware, firmware, and/or software including one or more computer program instructions. As will be appreciated, any such computer program instructions may be loaded onto a computer or other programmable apparatus to produce a machine, such that the instructions which execute on the computer or other programmable apparatus (e.g., hardware) create means for implementing the functions specified in the block(s) or step(s) of the flowcharts. These computer program instructions may also be stored in a computer-readable memory that may direct a computer or other programmable apparatus to function in a particular manner, such that the instructions stored in the computer-readable memory produce an article of manufacture including instruction means which implement the function specified in the block(s) or step(s) of the flowcharts. The computer program instructions may also be loaded onto a computer or other programmable apparatus to cause a series of operational steps to be performed on the computer or other programmable apparatus to produce a computer-implemented process such that the instructions which execute on the computer or other programmable apparatus provide steps for implementing the functions specified in the block(s) or step(s) of the flowcharts.

Accordingly, blocks or steps of the flowcharts support combinations of means for performing the specified functions, combinations of steps for performing the specified functions and program instruction means for performing the specified functions. It will also be understood that one or more blocks or steps of the flowcharts, and combinations of blocks or steps in the flowcharts, may be implemented by special purpose hardware-based computer systems which perform the specified functions or steps, or combinations of special purpose hardware and computer instructions.

Many modifications and other embodiments of the appliance and apparatus will come to mind to one skilled in the art to which this invention pertains having the benefit of the teachings presented in the foregoing descriptions and the associated drawings. It should therefore be understood that the appliance and apparatus are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus comprising:

a first switch electrically connected in line between an appliance and terminals of the appliance that are connectable to a power source of the appliance, wherein when the terminals are connected to the power source the first switch is configured to close when a door of the appliance is at least partially open to thereby connect the appliance to the power source, and configured to open when the door is closed to thereby disconnect the appliance from the power source;

a second switch electrically connected in line between the appliance and the terminals of the appliance, wherein when the terminals are connected to the power source the second switch is configured to close when the appliance enters an operational mode to thereby connect the appliance to the power source, and configured to open when the appliance enters an unpowered mode to thereby disconnect the appliance from the power source, the appliance being connected to the power source when at least one of the first switch or the second switch is closed, and disconnected from the power source when both the first switch and the second switch are open; and a third switch electrically connected to the second switch and configured to control the second switch to close upon actuation of the third switch, the third switch comprising a sensor configured to actuate in response to the sensor detecting a presence of a material, object or user in proximity of the appliance of a particular area of the appliance, wherein when the appliance is in the unpowered mode, actuation of the third switch causes the appliance to enter the operational mode.

2. The apparatus of claim 1 further comprising:

a latch circuit electrically connected to and configured to control operation of the second switch, wherein the latch circuit is configured such that when the appliance is in the unpowered mode and the second switch is open, the latch circuit is powered by the power source through the first switch when the door of the appliance is at least partially open and the first switch is closed.

3. The apparatus of claim 1 further comprising:

a latch circuit electrically connected to and configured to control operation of the second switch, wherein the latch circuit is configured such that when the appliance is in the unpowered mode and the first switch is open, the latch circuit is powered by an energy storage device electrically connected to the latch circuit.

4. The apparatus of claim 3, wherein the energy storage device comprises a capacitor arranged such that the capacitor is charged by the power source when at least one of the first switch or the second switch is closed.

5. The apparatus of claim 3, wherein the energy storage device comprises at least one of a battery or solar cell.

6. The apparatus of claim 1 further comprising:

a processor configured to control operation of the appliance, including being configured to control the second switch to open and thus control the appliance to enter the unpowered mode.

7. The apparatus of claim 6, wherein the appliance is configured to intentionally power down when the appliance enters the unpowered mode, wherein the processor is configured to set a flag in memory when the processor controls the appliance to enter the unpowered mode, and wherein the processor is configured to check the flag when the appliance enters the operational mode to determine if a preceding power down of the appliance was intentional or unintentional.

8. The apparatus of claim 1 further comprising:

one or more sensors configured to measure one or more characteristics of the material, object or user in proximity of the appliance or particular area of the appliance, and produce signals corresponding to the measured one or more characteristics; and a processor configured to receive the signals from the one or more sensors, and control operation of the appliance based on the signals.

9. The apparatus of claim 8, wherein the processor being configured to control operation of the appliance based on the signals includes being configured to apply logic to the signals to determine one or more operations, and control the appliance to perform the respective one or more operations, wherein the logic includes logic directing comparison of the signals to one or more predetermine threshold values, and directing performance of one or more operations based on the comparison.

10. The apparatus of claim 8, wherein the processor being configured to control operation of the appliance based on the signals includes being configured to apply logic to the signals to determine one or more operations, and control the appliance to perform the respective one or more operations, wherein the logic includes logic directing comparison of the signals to one or more predetermined signatures of multiple values that indicate a particular material, object or user, and directing performance of one or more operations based on the comparison.

11. An apparatus comprising:

a first switch electrically connected in line between an appliance and terminals of the appliance that are connectable to a power source of the apparatus, wherein when the terminals are connected to the power source the first switch is configured to close when the appliance enters an operational mode to thereby connect the appliance to the power source, and configured to open when the appliance enters an unpowered mode to thereby disconnect the appliance from the power source;

a second switch electrically connected to the first switch and configured to control the first switch to close upon actuation of the second switch, the second switch comprising a sensor configured to actuate in response to the sensor detecting a presence of a material, object or user in proximity of the appliance of a particular area of the appliance, wherein when the appliance is in the unpowered mode, actuation of the second switch causes the appliance to enter the operational mode; and a processor configured to control operation of the appliance, including being configured to control the first switch to open and thus control the appliance to enter the unpowered mode, wherein the appliance is configured to intentionally power down when the appliance enters the unpowered mode, wherein the processor is configured to set a flag in memory when the processor controls the appliance to enter the unpowered mode, and wherein the processor is configured to check the flag when the appliance enters the operational mode to determine if a preceding power down of the appliance was intentional or unintentional.

12. The apparatus of claim 11, wherein when, based on the check of the flag, the processor determines that the preceding power down of the appliance was unintentional, the processor is further configured to perform one or more error-handling operations, including being configured to direct presentation of indicia of the unintentional power down on a user interface of the apparatus.

13. The apparatus of claim 11, wherein when, based on the check of the flag, the processor determines that the preceding power down of the appliance was intentional, the processor is configured to reset the flag and control the appliance to enter the operational mode.

14. The apparatus of claim 11 further comprising a third switch electrically connected in line between the appliance and the terminals of the appliance, wherein when the terminals are connected to the power source the third switch is configured to close when a door of the appliance is at least partially open to thereby connect the appliance to the power source, and configured to open when the door is closed to thereby disconnect the appliance from the power source, wherein the appliance is connected to the power source when at least one of the first switch or the second switch is closed, and disconnected from the power source when both the first switch and the second switch are open; and a latch circuit electrically connected to and configured to control operation of the first switch, wherein the latch circuit is configured such that when the appliance is in the unpowered mode and the first switch is open, the latch circuit is powered by the power source through the third switch when the door of the appliance is at least partially open and the first switch is closed.

15. The apparatus of claim 11 further comprising:

a latch circuit electrically connected to and configured to control operation of the first switch, wherein the latch circuit is configured such that when the appliance is in the unpowered mode and the first switch is open, the latch circuit is powered by an energy storage device electrically connected to the latch circuit.

16. The apparatus of claim 15, wherein the energy storage device comprises a capacitor arranged such that the capacitor is charged by the power source when the first switch is closed.

17. The apparatus of claim 15, wherein the energy storage device comprises at least one of a battery or solar cell.

18. The apparatus of claim 15 further comprising:

a third switch electrically connected in line between the appliance and the terminals of the appliance, wherein the energy storage device comprises a capacitor arranged such that the capacitor is charged by the power source when at least one of the first switch or the third switch is closed.

19. The apparatus of claim 11 further comprising:

one or more sensors configured to measure one or more characteristics of the material, object or user in proximity of the appliance or particular area of the appliance, and produce signals corresponding to the measured one or more characteristics, wherein the processor being configured to control operation of the appliance includes being configured to receive the signals from the one or more sensors, and control operation of the appliance based on the signals.

20. The apparatus of claim 19, wherein the processor being configured to control operation of the appliance based on the signals includes being configured to apply logic to the signals to determine one or more operations, and control the appliance to perform the respective one or more operations, wherein the logic includes logic directing comparison of the signals to one or more predetermine threshold values, and directing performance of one or more operations based on the comparison.

21. The apparatus of claim 19, wherein the processor being configured to control operation of the appliance based on the signals includes being configured to apply logic to the signals to determine one or more operations, and control the appliance to perform the respective one or more operations, wherein the logic includes logic directing comparison of the signals to one or more predetermined signatures of multiple values that indicate a particular material, object or user, and directing performance of one or more operations based on the comparison.

* * * * *